US006181074B1

(12) United States Patent
Fischer

(10) Patent No.: US 6,181,074 B1
(45) Date of Patent: Jan. 30, 2001

(54) OPERATING CIRCUIT FOR DISCHARGE LAMPS WITH SWITCHABLE OPERATING STATES

(75) Inventor: Klaus Fischer, Friedberg (DE)

(73) Assignee: Patent-Treuhand-Gesellschaft fuer elektrische Gluehlampen mbH, Munich (DE)

( * ) Notice: Under 35 U.S.C. 154(b), the term of this patent shall be extended for 0 days.

(21) Appl. No.: 09/280,122

(22) Filed: Mar. 26, 1999

(30) Foreign Application Priority Data

Apr. 7, 1998 (DE) ..... 198 15 624

(51) Int. Cl.[7] ..... H05B 37/02

(52) U.S. Cl. ..... 315/219; 315/362; 315/313; 315/307

(58) Field of Search ..... 315/307, 291, 315/224, 209, DIG. 14, 219, 362, 313, 320

(56) References Cited

U.S. PATENT DOCUMENTS 3,605,016 * 9/1971 Zimmerii ..... 324/186
4,999,528 * 3/1991 Keech ..... 307/279
5,113,504 * 5/1992 Matsuda ..... 395/575
5,446,439 * 8/1995 Kramer et al. ..... 340/326
5,621,283 * 4/1997 Watson et al. ..... 315/362
5,798,620 * 8/1998 Wacyk et al. ..... 315/307

FOREIGN PATENT DOCUMENTS

0488002B1 6/1992 (EP) .
4037948C2 6/1992 (DE) .

* cited by examiner

*Primary Examiner*—Don Wong
*Assistant Examiner*—Tuyet T. Vo
(74) *Attorney, Agent, or Firm*—Carlo S. Bessone

(57) ABSTRACT

A circuit for operating a discharge lamp wherein a variable representing an operating state of the lamp is stored in an operating state storage device. A changeover device switches over between a plurality of operating states of the lamp. The operating state storage device is activated by each relatively short interruption of power to the operating circuit and switches over to an operating state other than that represented by the stored variable. A timer circuit separate from the operating state storage device is coupled to the voltage supply terminal of the operating state storage device and defines a specific time for distinguishing relatively long interruptions of the power supply from relatively short ones.

5 Claims, 2 Drawing Sheets

OPERATING CIRCUIT FOR DISCHARGE LAMPS WITH SWITCHABLE OPERATING STATES

BACKGROUND OF THE INVENTION

The invention relates to an operating circuit for a load. Discharge lamps, chiefly compact fluorescent lamps, come into consideration as the load.

Use is made in discharge lamps of operating circuits and electronic ballasts which can, for example, have a half-bridge oscillator with mains supply via a rectifier and a smoothing capacitor. In this case, the half-bridge oscillator generates a high-frequency AC voltage supply for the flicker-free and low-noise operation of the discharge lamp.

A substantial disadvantage of discharge lamps as against incandescent lamps and halogen incandescent lamps has hitherto consisted in that it has not been possible to implement a dimming function in the case of operating units of discharge lamps. At this juncture, a proposal belonging to the prior art has provided an improvement in which interruptions in the power supply of an operating circuit for a discharge lamp are evaluated and serve to some extent as a trigger signal in order to cause the operating circuit when restarting to operate further in another operating state with a larger or smaller lamp current. It is possible thereby to distinguish and switch two operating states which permit the lamp power to be reduced in a way similar to a dimming function if required. For this prior art, reference is made to EP 0 488 002 B1 and the associated priority application DE 40 37 948.

SUMMARY OF THE INVENTION

Starting from the outlined state of the art, this invention is based on the technical problem of specifying an operating circuit, in particular for discharge lamps, having operating states which can be switched by power supply interruptions, and having a circuit design which is further developed with respect to the properties of use by comparison with the cited prior art.

According to the invention, this problem is solved by a circuit for operating a load, in particular a discharge lamp, having an operating state storage device for storing a variable representing an operating state of the load, and having a changeover device for switching over between a plurality of operating states of the load, which is activated in the case of each relatively short interruption of the power supply of the operating circuit, and switches over into an operating state other than that represented by the stored variable, defined by a timer circuit separate from the operating state storage device, for defining a specific time for distinguishing relatively long interruptions of the power supply from the relatively short ones, the changeover device being activated by relatively long interruptions so as to switch into a fixed initial operating state.

Thus, it is provided according to the invention to distinguish power supply interruptions in accordance with their period. In this case, unlike the relatively short ones, relatively long interruptions do not lead to a changeover operation into another operating state, but to restarting in an operating state uniquely fixed independently of the previous operating state.

It is true that the cited EP 0 488 002 B1 already mentions such a stipulated aim, specifically switching over the bistable changeover system there into the initial state. However, this document provides no data on an approach to a technical solution for implementing this function.

Proceeding from this known stipulated aim, it could be considered obvious to start by attempting to design the store, which is intended to store the last operating state via a power supply interruption, in such a way that, starting from a certain time threshold, it loses the last operating state as its store contents. It would have to be ensured in this case that the loss of the store contents led to a defined initial state of the store. It would therefore be obvious to make use as operating state store of a capacitor which discharged in the case of a power supply interruption and which always had the "empty" state starting from a certain period of power supply interruptions.

The invention is based on the idea that in the case of this obvious approach two functions which should advantageously be realized separately are combined in one device. Consequently, the invention provides to separate the function of "store operating state" and the function of "define time threshold for power supply interruptions", that is to say to provide a timer circuit separate from an operating state storage device.

Advantages of this solution consist, for example, in that it is possible to make use for the operating state storage device of a store which emits a discrete, and thus always well defined output signal, relating to the operating state. This cannot be done straight away with a storage device which is intended to implement the timer function simultaneously and whose store contents must therefore "decay" with time.

A further advantage can be yielded when the output variable of the operating state storage device is used as desired value or to generate a desired value. If the timer function were then to be integrated in the operating state storage device, the outcome would be that in the case of short power supply interruptions the variable stored in the operating state storage device would scarcely have altered. However, since the aim is to switch over into another operating state after a short power supply interruption, this stored variable would no longer be suitable as desired value or for forming such a value.

In the solution according to the invention, by contrast, the separation of the timer circuit from the operating state storage device may have the effect, for example, of simultaneously making the timer circuit into a store for the operating state which comes after a short power supply interruption in the future, it being the case, however, that the variable stored in the actual operating state storage device serves for forming the desired value. However, it is also possible for a device which is switched over automatically by a trigger signal in the event of any power supply interruption to be used as the operating state storage device. By means of a defined resetting signal, said device can then hold as store contents the variable corresponding to the initial operating state. The resetting signal is triggered when the timer circuit determines a relatively long interruption of the power supply.

Overall, the solution according to the invention yields improved possibilities of circuit design which lead via the unique initial operating state after relatively long power supply interruptions to a greater convenience of operation and, in the way just outlined, to more reliable and more serviceable circuit designs.

It is preferably provided in the case of this invention that the timer circuit is of capacitive design and, specifically, has a smoothing electrolytic capacitor which is provided in many instances in any case on the output side of a mains rectifier and supplies the operating circuit. This smoothing electrolytic capacitor is then recharged in any case during operation by the mains rectifier and discharged in the event of power supply interruptions, with the result that its state of charge can be used to define time.

The discharging of the smoothing electrolytic capacitor in the event of interruption of the power supply can be performed in the case of a simple circuit variant by consumption currents of circuit components which are present in any case, for example by a consumption current of the operating state storage device. This discharging operation is prescribed in any case by the circuit design, and therefore offers an advantageous configuration—if the simplicity of the circuit is a leading concern.

On the other hand, the consumption currents are frequently relatively poor reference variables, because they are affected by manufacturing tolerances or can be strongly dependent on temperature, for example owing to the temperature dependence of the leakage currents. An improved variant of the invention therefore provides a separate discharge resistor which, together with the smoothing electrolytic capacitor, defines a discharge time characteristic, and thus the desired timer function. This discharge resistor should therefore be dimensioned such that the current flowing through it exceeds the previously mentioned consumption currents, and therefore dominates the discharging of the smoothing electrolytic capacitor. Again, it is necessary, of course, to take into account that the voltage dropping across the discharge resistor (as component voltage of a voltage division) provides an adequate supply voltage for circuit components supplied thereby.

If it is not the case that the overshooting of the time threshold value for distinguishing the relatively short from the relatively long power supply interruptions already leads by itself, for example by discharging of the abovementioned smoothing electrolytic capacitor, to the desired defined initial state of the operating state storage device, it is possible to provide a resetting device which resets the operating state storage device into the initial state. The changeover device is thereby also reset, with the result that the set initial operating state is present upon restarting the operating circuit. As already mentioned above and set forth in the exemplary embodiment —this resetting device is chiefly sensible when use is made of an operating state storage device which changes the stored variable in the event of each power supply interruption, whether relatively long or relatively short.

It is not mandatory to switch over between only two different operating states, as in the case of the cited European patent specification. Rather, it is also possible to use a changeover device to select three or more operating states and store them in the operating state storage device. Neither is it necessary in the case of the invention to consider only different lamp currents, and thus different lamp powers and brightnesses. Rather, the term operating state can be interpreted very generally and, for example, also be taken to mean the operation of different segments or different numbers of segments of a lamp or of different lamps of a lamp system. For the sake of clarity, it is also to be recorded that the state in which the entire operating circuit is switched off is not to be considered here as an operating state.

A further point of view of the invention consists in switching a comparator between the timer circuit and the operating state storage device. It is possible thereby for a continuously varying output value of the timer circuit, for example a continuously decreasing voltage across a discharging capacitor, to be converted into a discrete variable by the comparator. The operating state storage device thereby receives a signal from the timer circuit which by virtue of its defined and discrete variation avoids possible undefined intermediate states of the operating state storage device.

BRIEF DESCRIPTION OF THE DRAWINGS

The invention is explained below by way of example with the aid of a concrete exemplary embodiment which is shown in the figures.

BEST MODE FOR CARRYING OUT THE INVENTION

Figure 1:
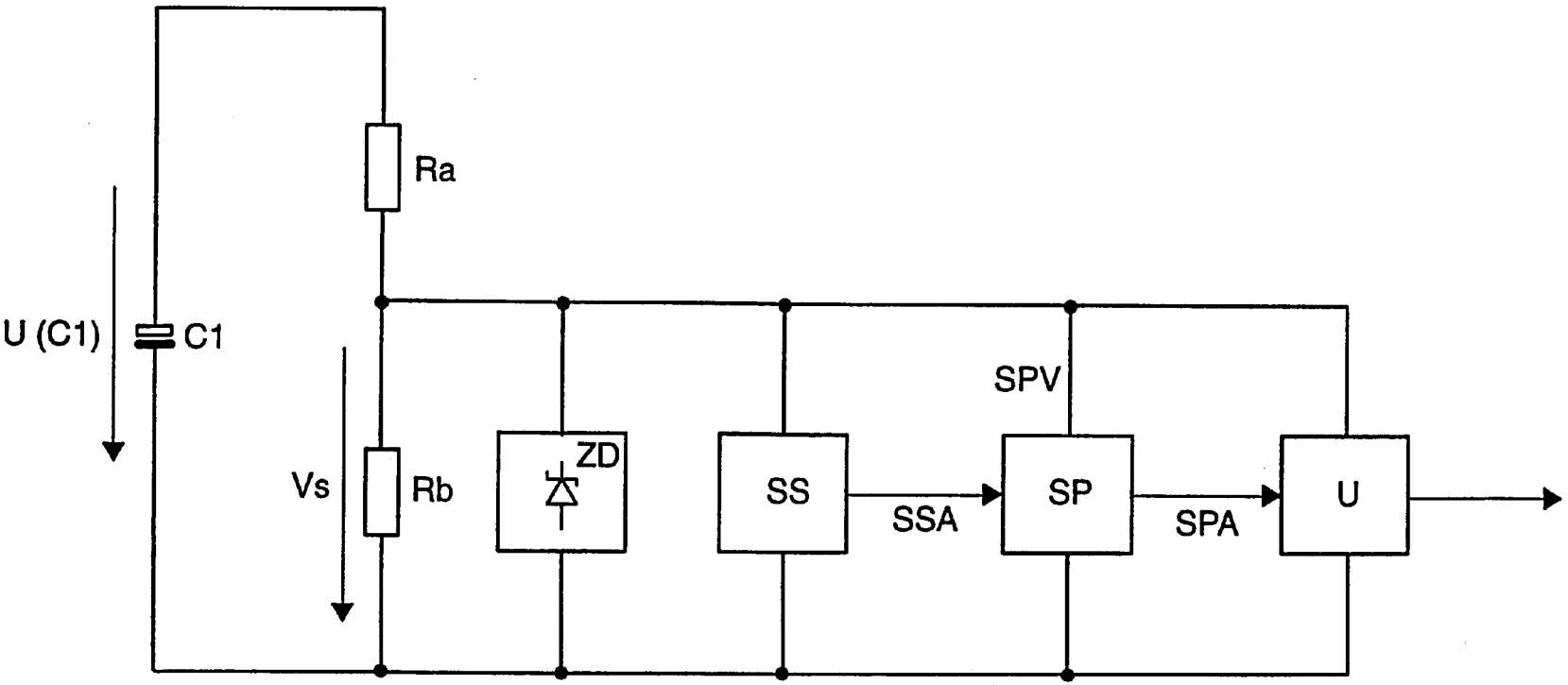
FIG. 1 shows a diagrammatic circuit diagram of an operating circuit according to the invention.

The components of the operating circuit which are essential to the invention are illustrated in FIG. 1, the representation of the conventional remainder of the operating circuit having been dispensed with. C1 illustrates an electrolytic capacitor which is connected between the output terminals of a mains rectifier for supplying the operating circuit, in order to smooth the rectified voltage. Supply branches not illustrated here lead from this smoothing electrolytic capacitor to a transistor half-bridge oscillator circuit which generates a high-frequency AC voltage supply for a low-pressure gas discharge lamp. The lower line illustrated in the figure and on the negative terminal of the electrolytic capacitor C1 serves here as reference potential for all components illustrated.

The electrolytic capacitor C1 further supplies an operating state storage device SP, specifically a so-called toggle flip-flop. In the case of a toggle flip-flop, the inverting output is fed back to the stored value input (not illustrated), with the result that in the case of an edge at the clock input the toggle flip-flop switches the inverted output signal through to the non-inverting output and thus changes its storage state. This is therefore a binary storage element which switches alternatingly with each edge. If more than two different operating states are to be switched over or stored in the operating state storage device SP, a binary counter is used instead of the binary toggle flip-flop as the operating state storage device SP.

After the power supply has been switched off, the operating state storage device SP is also supplied with voltage for a certain time via the electrolytic capacitor C1, specifically via the voltage supply terminal SPV.

The clock input of the operating state storage device SP is driven (in a way not illustrated) on the occasion of each power supply interruption. As a result, there is a change in the variable stored in the operating state storage device SP, and thus in the output signal SPA for each power supply interruption, independently of its duration. This clock input drive is performed as follows in the case of this exemplary embodiment: a drive IC of the oscillator circuit for operating the lamp is supplied by the oscillation during the oscillator operation. There is a further supply of the IC, which is connected to the rectifier on the mains side, for the starting phase before the oscillation begins. This supply is designed such that after a power supply interruption the IC becomes de-energized very much earlier than do the circuit components in FIG. 1 which are supplied by the electrolytic capacitor C1. The pulse for the clock input drive is then generated by the IC when the power supply is restored.

The output signal SPA of the operating state storage device SP is fed to a changeover device U which upon restarting of the operating circuit after a power supply interruption responds to the output signal SPA to select a specific one of at least two different operating states. The changeover device U can, for example, be a controller which uses the output signal SPA as a basis for its desired value.

Since, as a flip-flop, the operating state storage device SP is not defined with respect to the store contents in the case when the supply voltage is restored at the terminal SPV after a relatively long power supply interruption during which the supply voltage from the electrolytic capacitor C1 has fallen below a minimum value required to maintain the storage state, provision is made of a resetting device SS. This resetting device or starting circuit SS is a conventional undervoltage lockout circuit which supplies a time-limited signal via the output SSA to a resetting terminal of the operating state storage device SP in the event of a rise in the supply voltage, also present at it, above a settable threshold value. This resetting device therefore comes into use when the duration of the power supply interruption has caused the supply voltage Vs to drop below the threshold value of the resetting device SS. This threshold value is set such that it corresponds to a supply voltage at the operating state storage device SP which can reliably maintain its stored variable.

FIG. 1 further shows a voltage-limiting switching element ZD, a zener diode in the simplest case. This switching element ZD ensures that the level of the voltage across the electrolytic capacitor C1 does not lead to damage to the operating state storage device SP, the resetting device SS or the changeover device U.

It would be possible, in principle, to design the threshold value of the resetting device SS such that solely by means of the consumption currents of the blocks ZD, SS and SP, (as well as further circuit elements not illustrated), the discharging of the electrolytic capacitor C1 causes discharging to the threshold value of the resetting device SS in precisely that time which is aimed at as the limit between a relatively short power supply interruption (for switching over the operating state) and a relatively long power supply interruption (for restarting in the initial state). This time can amount to a second, for example.

However, it emerges that the temperature dependence of different leakage currents and tolerances in the components chiefly lead to a disturbing fluctuation in this time. Consequently, a discharge resistor Rb is provided at which the voltage limited by the voltage-limiting circuit element ZD is present. This discharge resistor Rb conducts a current which is greater than the sum of all the further currents discharging the electrolytic capacitor C1. Consequently, the time of the dropping of the supply voltage Vs to the threshold value of the resetting device SS is essentially determined by the total resistance of the series circuit composed of the discharge resistor Rb and a further resistor Ra which is connected in series with the electrolytic capacitor C1. This resistor Ra serves to separate the voltage limited by the block ZD from the voltage present at the electrolytic capacitor C1 by means of the voltage drop by virtue of the current flowing through the block ZD.

The comparator input, mentioned further above, of the operating state storage device SP is not required in the case of the exemplary embodiment outlined here, because the undervoltage lockout circuit SS ensures a defined limit between relatively short and relatively long power supply interruptions.

Figure 2:
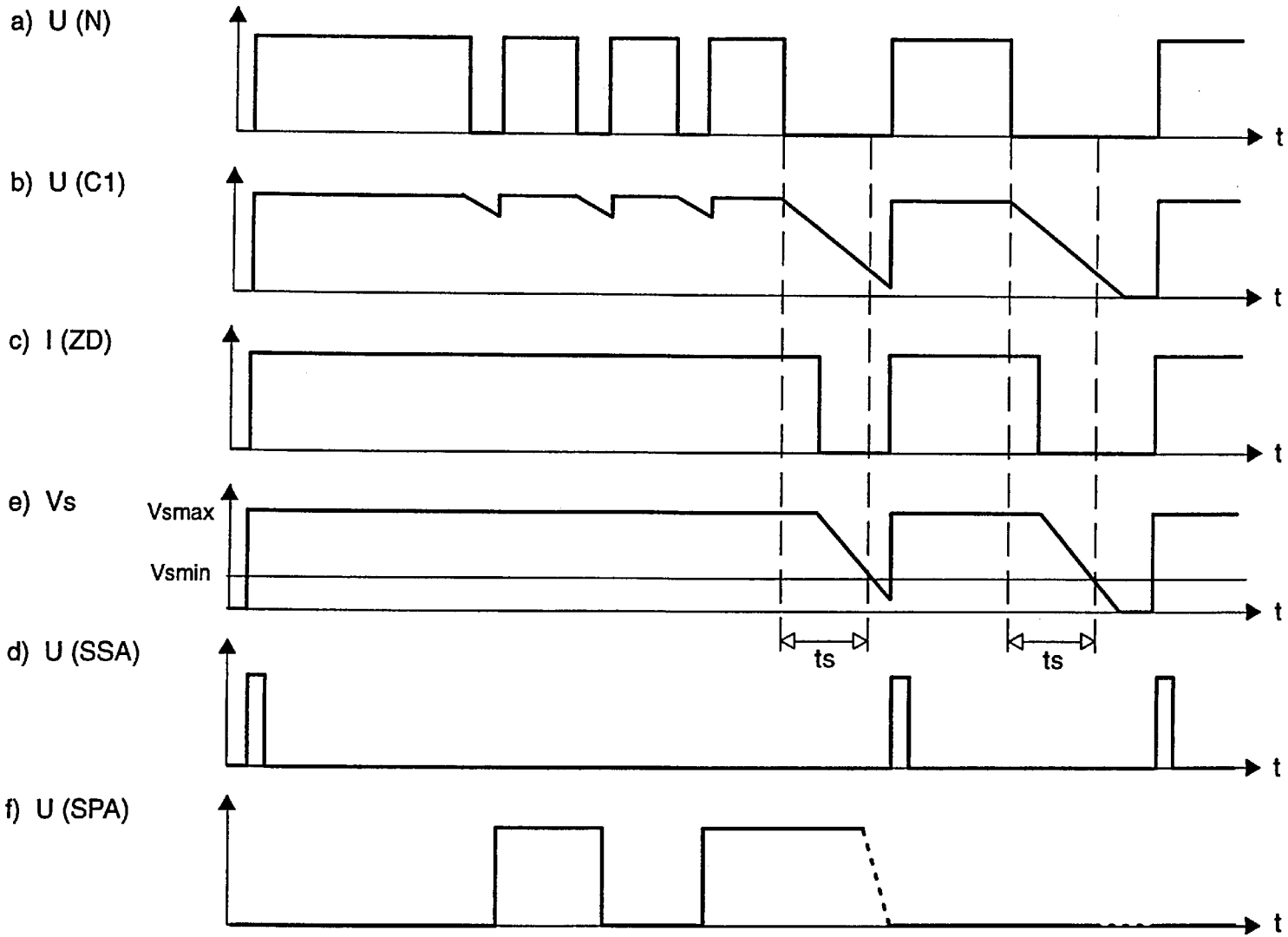
FIG. 2 shows time characteristics of different electric variables of the operating circuit represented in FIG. 1.

FIG. 2 illustrates the operation of the circuit according to the invention in a diagrammatic time characteristic diagram. Plotted in the first row a) is the line voltage of the power supply U(N) which exhibits in the time characteristic after a closing operation three short, and thereafter three relatively long interruptions (the third relatively long interruption no longer being shown). It is assumed in these figures that the oscillator (half bridge) stops immediately after the power supply is switched off; that is to say the running on owing to the charge in the capacitor C1 down to the undershooting of a voltage limit of the oscillator is not represented.

In the second row b), it is to be seen in the representation of the voltage U(C1) at the electrolytic capacitor C1 firstly that after the power supply has been switched on the capacitor C1 is immediately charged by the rectifier. In the case of the interruptions to the power supply, the voltage U(C1) drops with a specific time characteristic which is represented in a linear fashion here for the sake of simplicity. In fact, the time characteristic is exponential in the case of this exemplary embodiment.

In the case of the first three relatively short interruptions to the power supply, before the sudden renewed rise the voltage U(C1) drops to a substantially lesser degree than in the case of the following relatively long interruptions.

As illustrated in row c), the voltage-limiting switching element ZD continuously conducts a current I(ZD) through the relatively short interruptions when the power supply is switched on. In the case of the two relatively long interruptions, the voltage U(C1) drops to such an extent that the limiting voltage of the switching element ZD is undershot, with the result that the current I(ZD) stops suddenly. It rises again immediately with the voltage U(C1) after the power supply has been switched on. Starting from the instants within the relatively long power supply interruptions, at which the voltage-limiting function of the switching element ZD is interrupted, the voltage Vs across the resistor Rb drops from the value Vsmax given by the voltage-limiting switching element ZD. Here, as well, the actually exponential characteristic is represented linearly for the sake of simplicity. After a further period has elapsed, and overall by the time ts with respect to the switching-off of the power supply, that is to say offset by the drop in the voltage U(N), the supply voltage Vs drops below the illustrated value Vsmin, which corresponds to the threshold voltage of the resetting device SS. Consequently, after the power supply has been switched on again the output SSA of the resetting device SS generates a voltage pulse U(SSA), which is represented in the fifth row d).

The output signal U(SPA) in row f), which represents the stored variable of the operating state storage device SP therefore behaves as follows: as may be realized from the pulse U(SSA) in row d), the first connection of the time characteristic represented in FIG. 2 is a connection after a relatively long interruption. Having been reset to the initial state by the pulse U(SSA), the operating state storage device SP outputs a low value of its output voltage U(SPA) . The first short interruption leads to an edge, activating the toggle function of the operating state storage device SP, at the clock input thereof, and switches over the stored variable, and thus the output voltage U(SPA) to the high value. Similarly, after the next relatively long interruption there is a switch back to the previous state again. The third short power supply interruption also activates the toggle function and thereby leads again to the high value of the voltage U(SPA). This value is held defined until the supply voltage Vs is above the minimum value Vsmin. This is followed by an undefined state indicated by the edge, illustrated with dashes, of the voltage U(SPA). This lack of definition is not harmful, because the operating circuit and the gas discharge lamp are switched off at this time. The pulse of U(SSA) after the reconnection therefore ensures a defined resetting of the stored variable or of the operating state storage device. This change in operating state goes back not to the toggle function, simply because the output state was not defined, but to the pulse of the output voltage U(SSA) of the resetting device SS. This is to be seen after the following relatively long power supply interruption, for which it is the case not that there is a change into the other operating state, as would correspond to the toggle function, but that the initial state occurs again with a full lamp power.

This mode of operation is desirable because in order to switch over the gas discharge lamp the user employs the short disconnection or a short power supply interruption by actuating a push button, whereas restarting of the gas discharge lamp after disconnection actually intended in this way should not lead to a state which is possibly incapable of being foreseen by the user. It is sensible for the lamp to be operated at full brightness after a relatively long disconnection and to be capable of being "dimmed" via short interruptions.

This exemplary embodiment demonstrates the advantage of the invention that it can employ the smoothing electrolytic capacitor C1, which is present in any case, to integrate into the operating circuit a supplementary circuit by means of which power supply interruptions lead to different reactions, depending on their period. Power supply interruptions shorter than a time given by the dimensioning of the resistors Ra and Rb and the prescribed capacitance of the electrolytic capacitor C1 lead in conjunction with the set threshold voltage of the resetting circuit SS to a change in operating state between two or more operating states of the operating circuit or of the gas discharge lamp. It is thereby possible to undertake to set the brightness in a way which is comparable to a dimmer circuit in incandescent lamps. Because of the triggering of the resetting operation in the resetting device SS, power supply interruptions longer than the settable given time always lead to restarting of the operating circuit and thus of the operation of the gas discharge lamp in the initial operating state defined by the stored variable stored in the reset operating state storage device SP. There is thus no need in the present solution for any complicated formation of an analog measured variable by means of a dedicated RC combination and/or for an additional unit to discretize the analog measured variables.

What is claimed is:

1. A circuit for operating a load, in particular a discharge lamp, having an operating state storage device (SP) with a voltage supply terminal for storing a variable (SPA) representing an operating state of the load, and having a changeover device (U) for switching over between a plurality of operating states of the load, said operating state storage device (SP) is activated in the case of each relatively short interruption of power to the operating circuit, and switches over into an operating state other than that represented by the stored variable (SPA), defined by a timer circuit (C1,Ra,Rb) separate from the operating state storage device (SP) and coupled to the voltage supply terminal of the operating state storage device, for defining a specific time (ts) for distinguishing relatively long interruptions of power from the relatively short ones, the changeover device (U) being activated by relatively long interruptions so as to switch into a fixed initial operating state.

2. The operating circuit as claimed in claim 1, in which the timer circuit (C1,Ra,Rb) has a smoothing electrolytic capacitor (C1) on for the purpose of supplying the operating circuit, and defines the specific time (ts) via the discharging of this capacitor (C1).

3. The operating circuit as claimed in claim 2, having a discharging resistor (Rb) for the discharging of the smoothing electrolytic capacitor (C1).

4. The operating circuit as claimed in claim 3, having a resetting device (SS) for resetting the operating state storage device (SP) and the changeover device (U) after each relatively long interruption.

5. The operating circuit as claimed in claim 4, in which the changeover device (U) switches over alternately between more than two operating states.

* * * * *